US005214406A

United States Patent [19]

Reese et al.

[11] Patent Number: 5,214,406

[45] Date of Patent: May 25, 1993

[54] SURFACE MOUNTED CARTRIDGE FUSE

[75] Inventors: Lloyd W. Reese; Larry J. Brashear; Daniel B. Onken, all of Centralia, Ill.

[73] Assignee: Littelfuse, Inc., Des Plaines, Ill.

[21] Appl. No.: 843,373

[22] Filed: Feb. 28, 1992

[51] Int. Cl.[5] ..... H01H 85/16

[52] U.S. Cl. ..... 337/231; 337/232; 337/251; 337/252

[58] Field of Search ..... 337/231, 227, 228, 234, 337/236, 237, 238, 246, 248, 251, 252, 253, 297; 361/409

[56] References Cited

U.S. PATENT DOCUMENTS

| | | | |
|---|---|---|---|
| 4,139,881 | 2/1979 | Shimizu et al. | 361/409 |
| 4,159,458 | 6/1979 | Wiebe | 337/252 |
| 4,467,308 | 8/1984 | Arikawa et al. | 337/231 |
| 4,920,327 | 4/1990 | Arikawa et al. | 337/231 |

*Primary Examiner*—Harold Broome

*Attorney, Agent, or Firm*—Wallenstein, Wagner & Hattis, Ltd.

[57] ABSTRACT

A surface-mounted fuse has a hollow, open-ended insulating fuse body with a square sided central portion terminating in opposite, preferably square-sided, recessed, tapered end portions. A pair of preferably square-sided conductive end caps are provided having end walls respectively confronting the open ends of the fuse body and side walls enveloping the tapered end portions thereof. The side walls of the end caps define annular tapered cavities to receive without compressing the fuse wire one or more bent back ends of a fuse wire. The recessing of the tapered end portions of the fuse body provides axially outwardly facing abutment shoulders which limit the extent to which the end caps can be moved over the fuse body during assembly. The end walls of the end caps are then spaced from the ends of the fuse body to form outer spaces of greater size than the fuse element thickness, so that the ends of the fuse element are not compressed between the end cap end walls and the ends of the fuse body.

19 Claims, 2 Drawing Sheets

Fig. 1
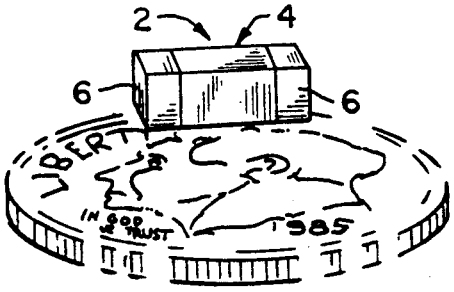
Fig. 2
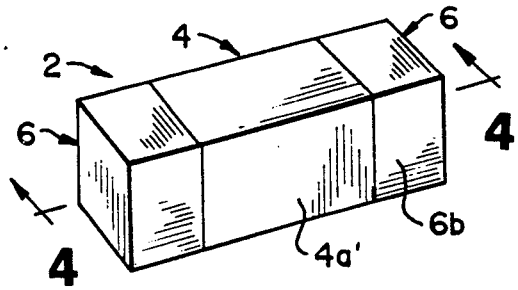
Fig. 3
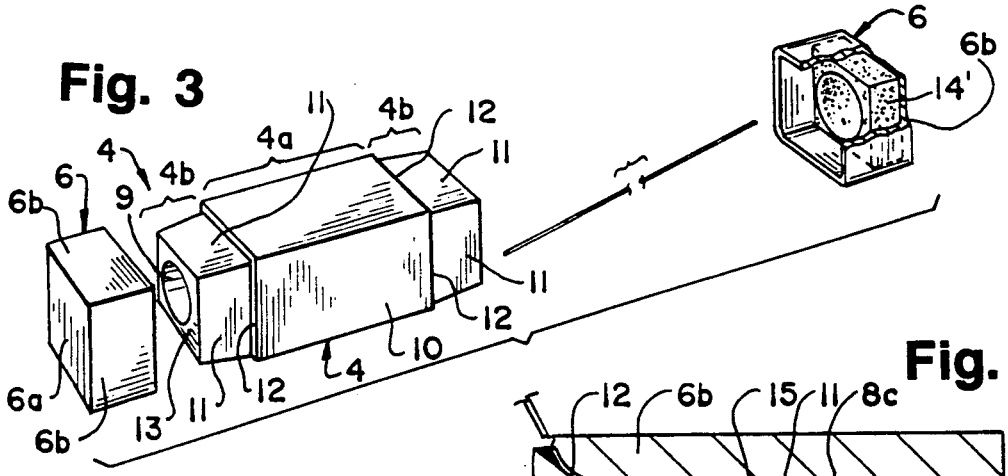
Fig. 6
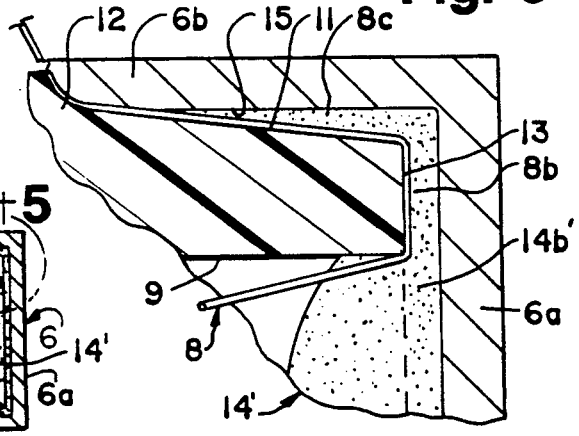
Fig. 4
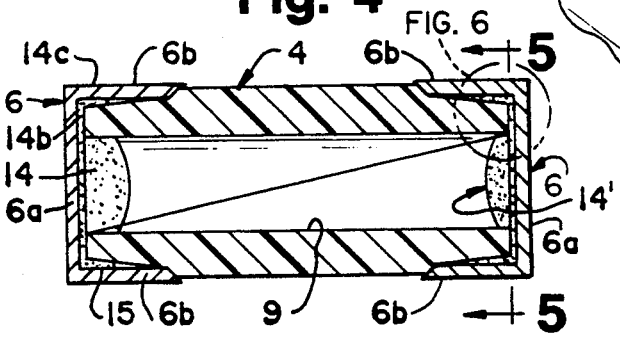
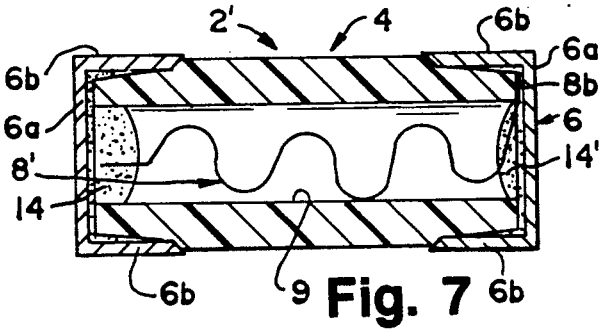
Fig. 7
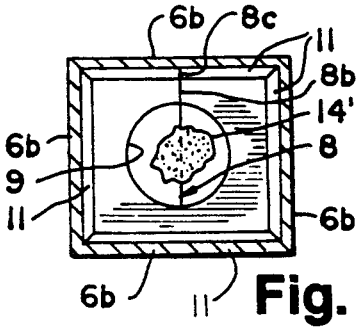
Fig. 5

SURFACE MOUNTED CARTRIDGE FUSE

FIELD OF INVENTION

The present invention has its most important application in miniature cartridge fuses which are to be mounted on the flat surfaces of printed circuit boards. Such cartridge fuses are commonly referred to as surface-mounted cartridge fuses. By miniature cartridge fuses are meant fuses which have a housing (before any encapsulation) with a transverse outer dimension no more than about 0.135".

BACKGROUND OF INVENTION

Surface-mounted cartridge fuses generally comprise a hollow, insulating body defining a fuse element-receiving passageway opening onto the opposite outer ends thereof. One and preferably all sides of the body have a flat surface parallel to the longitudinal axis of the fuse so that the fuse will not roll when placed on a printed circuit board. Cup-shaped metal end caps are telescoped over the opposite ends of the insulating fuse body. In a surface mounted fuse, it is also sometimes desirable that the end caps have a consistent square profile larger than the fuse body and presenting identical flat surfaces also extending parallel to the fuse axis so that any side of the end cap can lay flush against a conductive area on a printed circuit board. The end caps are leadless and the sides of the end caps are generally soldered to these spaced conductive areas on the surface of the printed circuit board.

The fuse elements of miniature cartridge surface-mounted fuses commonly comprise fuse wires extending diagonally across the fuse bodies where they are bent back over the body ends and sandwiched between the end caps and the fuse body.

Surface-mounted fuses are commonly applied to the printed circuit boards by automated equipment which grasps the individual fuses and applies them to the desired areas of the printed circuit board where the end caps thereof are to be soldered thereto. The reliability of the application procedure by automated fuse grasping and carrying equipment is facilitated if the exposed portion of the fuse body has a square rather than a round shape. By making the fuse symmetrical, the fuse grasping procedure is simplified since it is a simple matter to grasp any flat side of a fuse and then properly position it on the board so that corresponding parallel flat sides of the end caps rest upon the flat conductive areas of the printed circuit board. One example of such a surface mounted fuse is disclosed in U.S. Pat. No. 4,920,327, granted Apr. 24, 1990. The fuse body disclosed therein has a consistent square cross section throughout its length and square sided end caps which close and envelope the open, square ends of the fuse body.

Miniature surface-mounted fuses pose particularly difficult assembly problems in their fabrication. In the first place, the fuse wires are very thin and so can be readily severed if during assembly of the end caps to the fuse body the fuse wire bent back ends are crushed and/or stretched to a breaking point. As disclosed in the latter patent, in an effort to avoid stretching the fuse wire during assembly of the end cap to the fuse body ends recesses are formed in the outer periphery of the fuse body to receive the bent back portions of the fuse wire. However, the solder coated end walls of the end caps press against the portion of the fuse wire extending over the outer faces of the fuse body and so can crush and damage the fuse wire. The assembly procedures for such a fuse also requires a precise positioning of the fuse wire so the ends thereof fit into the recesses.

The present invention provides a rectangular-sided, surface-mounted fuse having a substantially different and improved construction from that disclosed in U.S. Pat. No. 4,920,327. This unique construction avoids damage to the fine fuse wire without the need for recesses in the periphery of the fuse body, and without the need for compressing the ends of the fuse wire between the end caps and the end faces of the fuse body.

SUMMARY OF THE INVENTION

The most advantageous form of the present invention has a fuse body with a central portion having a consistent square profile to present four flat surfaces of preferably identical size which can be readily grasped by fuse-grasping equipment used to apply the fuses to the surface of a printed circuit board. The fuse body has longitudinal end portions which are also preferably, although not necessarily, square-sided and outwardly tapered. These tapered portions preferably begin at points stepped radially inwardly of the outermost body periphery, so as to define four, axially-outwardly facing, straight abutment shoulders. The end edges of the side walls or flanges of a pair of preferably square-sided cup-shaped end caps abut these shoulders which thereby precisely position the end walls of the end caps in spaced relation to the end faces of the fuse body, so that the fuse wire ends are not crushed and broken by the end caps.

The tapered portions of the fuse body also aid in guiding the end caps into place during assembly. They also form annular cavities with the side walls of the end caps of greater size for most of their length than the thickness of the fuse wire. If one or more ends of the fuse wire are bent back over the fuse body ends, they are not engaged by the side walls of the end caps for most of the length thereof. To simplify fuse assembly it is preferred that only the very endmost portions of the bent back ends of the fuse wire are lightly sandwiched between the end cap side walls and the fuse body at and adjacent to the abutment shoulders. However, in accordance with the broadest aspect of the invention, the bent back ends of the fuse element may terminate before they can be engaged by the side walls of the end caps.

Another advantage of the recessed tapered portion at each end of the fuse body is that this permits a projection of the outer surfaces of the side walls of each end cap from the corresponding flat surface of the square central portion of the fuse body by a fraction of the thickness of the end cap side walls. This small projecting distance of the end caps from the central portion of the fuse body forms a desirable shallow indentation in the outer profile of the fuse body, so that trademark and fuse rating indicia can be easily applied to an exposed flat side of the fuse body. It also forms a space for a spot of adhesive used to secure the fuse body to the printed circuit board when it is initially placed thereon.

The ends of the fuse wire are electrically joined to the end caps by bodies of solder which preferably extends partway into, and in some cases preferably fully fills, the annular cavities at the ends of the fuse body, to form a more extensive electrical and physical interconnection between the ends of the fuse wire and the end caps.

Also, the solder in these cavities more securely connects the end caps to the fuse body.

A prior art patent of interest is U.S. Pat. No. 1,861,369 to E. D. Sundt. This patent discloses a fuse with a fusible element bent back over the slightly tapered ends of a fuse body. However, the taper is so slight that the annular recess provided by the tapering is of such insignificant size that it does not avoid the crunching of the bent back ends of the fuse wire by the end caps.

U.S. Pat. No. 4,159,458 to Gerald L. Wiebe discloses a cylindrical cartridge fuse where a fuse wire is encapsulated by the insulating fuse body or housing. The vertical end caps having a stepped profile providing a shoulder on each end cap which abuts the adjacent end of the fuse body to space a right-angle bent end of the fuse wire from the end wall of the end cap. In the Wiebe fuse, there are no annular or other cavities defined between the side walls of the end caps and the right-angled bent ends of the fuse wire, and the fuse wire does not extend between the side walls of the end cap and the fuse body, as in the case of the preferred form of the present invention.

U.S. Pat. No. 1,494,141 to Snow discloses a cylindrical fuse with end caps enveloping recessed end portions of a fuse body. However, this fuse is not a surface-mounted or miniature fuse and the function and purpose of the construction of the fuse disclosed in this patent is so foreign to surface-mounted or miniature fuses that it is not relevant to the present invention.

The above described and other features of the invention will become apparent upon making reference to the specification to follow, the claims, and the drawings.

DESCRIPTION OF DRAWINGS

FIG. 1 is a perspective view of the miniature surface-mounted fuse of the present invention positioned adjacent to a United States dime to show the extreme miniaturization of the preferred form of the present invention;

FIG. 2 is a larger perspective view of the fuse shown in FIG. 1;

FIG. 3 is an exploded view of the fuse shown in FIGS. 1 and 2;

FIG. 4 is a horizontal sectional view through the fuse shown in FIG. 2, taken along section line 4—4;

FIG. 5 is a transverse sectional view through the fuse shown in FIG. 4, taken along section line 5—5;

FIG. 6 is a greatly enlarged fragmentary view of that portion of FIG. 4 which is encircled by a dashed line;

FIG. 7 is a longitudinal sectional view through a modified fuse where the fuse element is corrugated.

DESCRIPTION OF PREFERRED FORMS OF THE INVENTION

Figure 8:
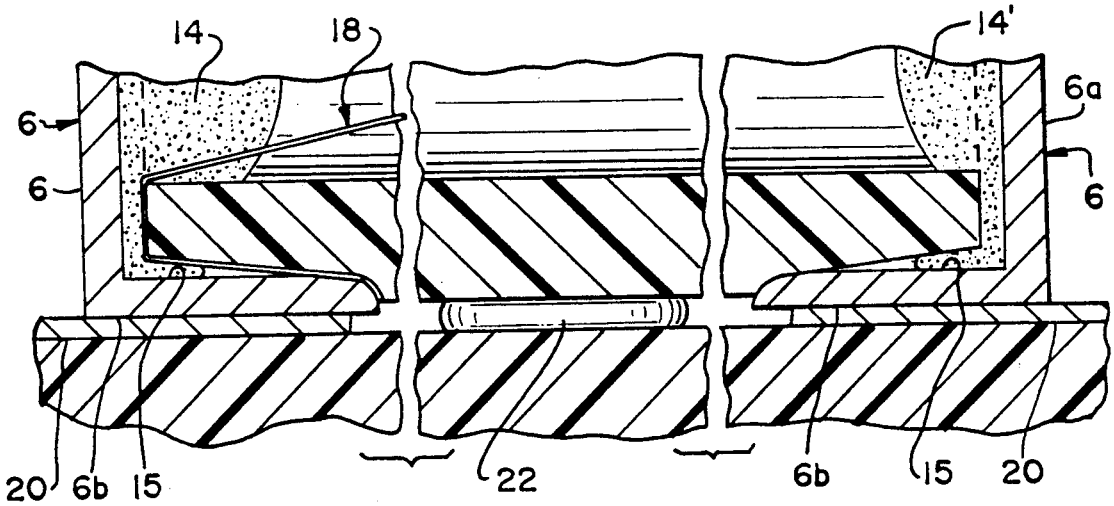
FIG. 8 is a broken-away vertical longitudinal sectional view of the fuse of FIGS. 1–6 mounted on a printed circuit board.

As best shown in the exploded view of FIG. 3, the most preferred form of the invention comprises an assembly of four preformed parts 4, 6—6 and 8. The part 4 is a hollow insulating fuse body or housing 4 preferably, but not necessarily, having a square cross-sectional profile throughout its length. A preferably cylindrical passageway 9 extends longitudinally through the center of the fuse body 4 and opens onto transversely extending flat end faces 13—13 of the fuse body through openings unnumbered in the drawings. The parts 6—6 are metal, square sided, terminal-forming end caps 6—6 partially filled with solid bodies of solder and sized to fit over the ends of the fuse body 4. As best shown in FIG. 4, a fuse wire 8 is provided sized to extend tautly diagonally across the opposite ends of the fuse body and then pass over the end faces 13—13 and into annular, tapered cavities 15—15 formed between the side walls *6b—6b* of the end caps 6—6 and outwardly tapered end portions *4b—4b* of the fuse body 4.

The unique features of the invention deal with the configuration of the fuse body 4 and its relationship to the end caps and fuse wire or other fuse element which can take a number of different forms. In FIGS. 1–6, the fuse element is a thin fuse wire as just described. The fuse wire 8 could be replaced by other fuse element configurations, such as the corrugated fuse wire of the fuse element 8' shown in the embodiment of the invention shown in FIG. 7.

As shown in FIG. 3, the fuse body 4 has a central portion *4a* having a consistent outer square cross-sectional profile. The central portion of the fuse body therefore has four flat surfaces 10 which intersect at four corners of the fuse body and extend in planes parallel to the longitudinal axis of the fuse body 4. The central portion *4a* of the fuse body joins the tapered end portions *4b—4b* thereof beginning at points stepped radially inwardly of the periphery of the central portion *4a* of the fuse body. Four shallow, axially outwardly extending abutment shoulders 12 are thus formed at the ends of the central portion *4a* of the fuse body. These shoulders are shown as rounded shoulders which correspond to the rounded end edges of the side walls *6b* of the end caps which abut these shoulders.

The tapered end portions *4b—4b* of the fuse body have a square cross sectional profile of progressively decreasing size. The end portions *4b—4b* thus have four flat, radially inwardly inclining outer flat surfaces 11 intersecting at corners aligned with the corners of intersections of the flat sides of the central portion *4a* of the fuse body.

The cylindrical passageway 9 opening onto the central portion of the fuse body end faces 13—13 to provide end face shapes where the width of each end face varies between minimum widths at points midway between the corners of the square margins thereof. The bent back ends of the fuse wire have portions *8b—8b* passing over these narrowest portions of the fuse body end faces 13—13 and portions *8c—8c* extending into the annular tapered cavities 15—15.

The four corners of the square margins of the end caps 6—6 are in alignment with the four corners of the square margins of the fuse body 4. Also as shown in FIG. 6, the inner dimensions of the end cap side walls are less than the corresponding dimensions of the central portion *4a* of the fuse body, so that the rounded end edges of the side walls *6b* of each end cap will abut the shoulders 12 at the margins of the fuse body portion *4a*. The end walls *6a—6a* of the end caps are then spaced from the end faces 13—13 of the fuse body a distance greater than the thickness of the fuse wire 8. The end walls will therefore not press against the bent over portions *8b—8b* of the fuse wire 8.

As shown in FIG. 6, the thickness of the fuse wire 8 is substantially less than the size of the annular cavities 15-1 for most of the lengths thereof, and so the fuse wire is desirably not compressed between the side walls of the end caps and the fuse body for all or most of the length of the fuse wire ends *8c—8c* should the ends of the fuse wire extend the full lengths of the cavities 15—15. As previously indicated, the end of each fuse wire preferably extends the full length of the associated annular cavity where the very end portion thereof is lightly sandwiched between the end cap side wall and the fuse body only in the vicinity of the adjacent abutment shoulder. However, in accordance with the broadest aspect of the invention, the fuse wire ends could terminate short of the end of the cavities so that the fuse element is not contacted by the side walls of the end caps.

The outermost dimensions of the side walls 6b of each end cap is preferably greater than the corresponding dimensions of the central portion of the fuse body, so that the flat outer faces of the end cap side walls 6b project beyond the periphery of the central portion of the fuse body. Therefore, when the fuse body is placed on a printed circuit board, the flat sides of the end caps which face down upon the board will make good electrical connection with conductive areas on the board. The fuse is anchored in place on the printed circuit board by soldering the end caps to these conductive areas.

The cartridge fuse just described may be assembled in any one of a number of different ways. In all of these different assembly methods, it is preferred that the first step in the assembly process is to orient one of the end caps so the open end thereof faces upwardly. As previously indicated, each end cap initially has a body of solid solder filling part of the interior thereof.

Preferably, before this solder is melted, the fuse body 4, with the bottom end of the fuse wire 8 bent around the then bottom end thereof to a point where it extends outside of the end cap, is inserted into the open top of the end cap. Then, upon application of a slight downward pressure on the fuse body, the other end of the fuse wire is bent tautly around the upper end of the fuse body also with the fuse wire extending beyond the adjacent abutment shoulder 13. The other end cap is then placed over the upper end of the body.

The solder in the bottom end cap is then initially melted and a slight downward pressure is applied to the upper end cap which presses the fuse body into the molten solder and displaces the same so the solder balls up in the central portion of the fuse body, as shown in FIG. 4. Some of the solder will also desirably be displaced up into the adjacent annular cavity 15. The solder in the upper end cap is then rendered molten and, because of the small size of the cylindrical passageway 9 in the fuse body and the back pressure developed when the upper end cap is pushed over the fuse body, the melted body of solder in the upper end cap cannot flow freely into the passageway 9. Rather, it usually desirably bulges slightly into the central portion thereof and is pressed by the upper end cap into the adjacent annular cavity 15 at the upper end of the fuse body where the solder fills the adjacent annular cavity 15. After assembly is completed, the ends of the fuse wire projecting from the end caps are severed.

The following are exemplary specifications for making fuses from 1/16 amp to 1½ amps like that illustrated in FIGS. 1-6:

Fuse Body Specifications:
- Housing Material—Ceramic—Steatite
- Overall Length—0.241"±0.007"
- Length of Square Sided Central Portion 4a—0.119"
- Taper Angle to Horizontal—7¼.
- Diameter of Passageway 9—0.048"
- Depth of Curved Shoulder 12—0.0035"

End Cap Specifications:
- Overall Length of Side Wall 6b—0.0565"
- End Cap Material—Brass Tin/Lead Plated
- Thickness of End Cap—0.0065"±0.01"

Fuse Wire Specification:
- Fuse Wire Material—Nickel or Dumet
- Diameter—0.00039 to 0.00191"

As previously indicated, the present invention is applicable to a surface-mounted fuse 2' shown in FIG. 7 where the fuse element 8' has a corrugated configuration. In the process of assembly of the fuse 2, the bottom end of the fuse wire 8" is not bent around the bottom edge of the fuse body when inserted into the end cap. Rather, it is merely pushed down into the melted body of solder. However, the upper end of the fuse wire 8' is bent around the upper edge of the fuse body preferably at a point where the adjacent end face 13 of the fuse body has a minimum width. In the process of pulling the upper end of the fuse wire 8' around the upper end of the fuse body, the central portion of the fuse wire bows so as to bring it adjacent to or in contact with the fuse body wall.

Refer now to FIG. 8 which is a vertical longitudinal sectional view through the fuse of FIGS. 1-6 when mounted upon a printed circuit board 18. The printed circuit board 18 has spaced conductive areas 20—20 upon which a pair of the flat sides 6b—6b of the end caps 6—6 rest. The end caps are also preferably connected to the conductive areas 20—20 by bodies of solder (not shown).

A spot of adhesive 22 located between the spaced conductive areas 20—20 of the printed circuit board adhesively adheres a flat side of the central portion 4a of the fuse body to the printed circuit board as it is positioned thereon. Initially, a smaller but thicker spot of adhesive is applied to the printed circuit board. It is spread a small amount as the fuse body is placed on the printed circuit board. The adhesive desirably is spread to a limited extent so that it does not project beyond the margins of the fuse body.

In summary, the preferred aspect of the invention provides a tapering of the end portions of the fuse body to provide tapered cavities for receiving solder and/or the bent back end or ends of fuse wire without breakage of the fuse wire during assembly. The tapering of the fuse body ends also provides surfaces for guiding the square sided end caps into position where the ends of the end cap side walls abut the shoulder 12.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In a surface-mounted fuse comprising a hollow insulating fuse body defining an interior, longitudinally-extending, fuse element-receiving passageway, said body having a central portion terminating in opposite longitudinal end portions, at least one of said central and longitudinal end portions having a profile presenting flat side surfaces, said passageway opening at the opposite longitudinal ends of said fuse body to the exterior of said body through a pair of axially, outwardly-facing openings; a pair of conductive end caps for making electrical connection to an external electrical circuit, said end caps comprising end walls respectively confronting said fuse body passageway openings and longitudinally-extending side walls enveloping said longitudinal end portions of said body; bodies of solder in said end caps; and a fuse element in said passageway extending between the longitudinal ends of said body and having end portions physically and electrically connected to said end caps through said solder bodies, at least one end portion of said fuse element being bent back over the adjacent end of the fuse body; the improvement wherein each longitudinal end portion of said fuse body adjacent a bent back portion of said fuse element is outwardly tapered to define a tapered cavity between said fuse body and the adjacent end cap side wall which forms a recess extending around the periphery of said fuse body; each bent back portion of said fuse element having a thickness less than the size of the adjacent annular cavity for most of the length thereof, so at least a major portion of the length of each bent back portion of said fuse element is not crushed by the adjacent end cap side wall.

2. In a surface-mounted fuse having a hollow insulating fuse body defining an interior, longitudinally-extending, fuse element-receiving passageway, said body having a central portion terminating in opposite longitudinal end portions, at least one of said central and longitudinal end portions having a profile presenting flat side surfaces, said passageway opening at the opposite longitudinal ends of said fuse body to the exterior of said body through a pair of axially, outwardly-facing openings; a pair of conductive end caps for making electrical connection to an external electrical circuit, said end caps comprising end walls respectively confronting said fuse body passageway openings and longitudinally-extending side walls enveloping said longitudinal end portions of said body; bodies of solder in said end caps; and a fuse element in said passageway extending between the longitudinal ends of said body and having end portions physically and electrically connected to said end caps through said solder bodies; the improvement wherein said longitudinal end portions of said insulating body are outwardly tapered to define tapered cavities forming recesses around the periphery of the end portions of said fuse body; the tapering of said fuse body end portions beginning at points stepped radially inwardly of the periphery of the central fuse body portion periphery so as to provide axially outwardly facing abutment shoulders, the end edges of said end cap side walls abutting said shoulders to limit the extent to which the end caps can be moved over said fuse body during assembly, said end walls of said end caps being thereby spaced from the ends of the fuse body to form outer spaces of greater size than the fuse element thickness, so that the ends of the fuse element are not crimped or compressed between the end walls of the end caps and the end faces of the fuse body.

3. The surface-mounted fuse of claims 1 or 2 wherein at least some of the solder at each end of the fuse body extends into the annular cavities thereat to more securely anchor the end caps to the fuse body.

4. The surface-mounted fuse of claim 3 wherein at least one of said tapered cavities is completely filled with solder.

5. The surface-mounted fuse of claim 1 wherein the body of solder which connects each bent back portion of said fuse element to the adjacent end cap at least partially extends into the adjacent annular cavity.

6. The surface-mounted fuse of claims 1 and 2 wherein said central portion of said longitudinal body has a consistent square profile along substantially its entire length.

7. The surface-mounted fuse of claim 1 or 2 wherein each of said longitudinal end portions of said fuse body has a progressively varying outer square profile, and said end caps have side walls with a consistent outer square profile.

8. The surface-mounted fuse of claims 1 or 2 wherein the outer periphery of said fuse body and the side walls of said end caps have a rectangular outer cross sectional profile over their entire lengths.

9. The surface-mounted fuse of claims 1 or 2 wherein the outer periphery of said fuse body and the side walls of said end caps have a square outer cross sectional profile over their entire lengths.

10. The surface-mounted fuse of claims 1 or 2 wherein the fuse is a miniature fuse where the transverse outer dimensions of the fuse body are no greater than about 0.135".

11. The surface-mounted fuse of claim 2 wherein said solder body in one of said end caps completely fills the adjacent annular cavity defined between the side wall of the end cap and the fuse body.

12. The surface-mounted fuse of claim 11 wherein the solder body in the other end cap only partly fills the adjacent annular cavity defined between the adjacent end cap side wall and the fuse body.

13. The surface-mounted fuse of claims 1 or 2 wherein said fuse element is a corrugated element having one end projecting into the solder body in one of said end caps and terminating therein, and the other end of the fuse element is bent around the adjacent end of the fuse body and extends into the adjacent annular cavity defined between the end cap side wall and the fuse body thereat.

14. The surface-mounted fuse of claims 1 or 2 wherein said passageway is a cylindrical passageway centered within the fuse body.

15. The surface-mounted fuse of claim 14 wherein the fuse body has at the opposite ends thereof end faces extending in planes at right angles to the longitudinal axis of the fuse body, a cylindrical passageway opening onto these end faces in a centered position thereon, said end faces thus having a width which varies from a minimum width at points midway between the corners of the outer square profile of the tapered end portions of the fuse body, and said fuse element is a fuse wire tautly stretched across the opposite diagonal ends of the fuse body passageway and having end portions bent back to extend into said annular cavities at the opposite ends of the fuse body at said minimum width points of the end faces of the fuse body.

16. In a surface-mounted fuse having a hollow insulating fuse body defining an interior, longitudinally-extending, fuse element-receiving passageway, said body having a central portion terminating in opposite longitudinal end portions, said central portion having a rectangular profile presenting flat side surfaces extending parallel to the longitudinal axis of said passageway, one of said flat side surfaces to be adhesively anchored to a printed circuit board, said passageway opening at the opposite longitudinal ends of said fuse body to the exterior of said body through a pair of axially, outwardly-facing openings; a pair of conductive end caps for making electrical connection to an external electrical circuit, said end caps comprising end walls respectively confronting said fuse body passageway openings and longitudinally-extending side walls, said side walls enveloping said longitudinal end portions of said body; and a fuse element in said passageway extending between the longitudinal ends of said body and having end portions physically and electrically connected to said end caps; the improvement wherein said longitudinal end portions of said insulating body are recessed around the periphery of said fuse body beginning at points stepped radially inwardly of the periphery of the central portion of the fuse body so as to provide an annular space to receive said side walls of said end caps, the outer surfaces of said end cap side walls projecting beyond said flat surfaces of said central portion of the fuse body by an amount which is a fraction of the thickness thereof, so that said end caps can rest upon parallel conductive areas on said printed circuit board and the corresponding surface of said central portion of said fuse body is spaced a relatively small distance from said printed circuit board, to accommodate a thin layer of adhesive which adheres said fuse body to said printed circuit board.

17. The surface-mounted fuse of claim 16 wherein said longitudinal end portions of said fuse body and said side walls of said end caps have complementary rectangular profiles, the outer surfaces of said end cap side walls being parallel to said flat side surfaces of said central portion of said fuse body.

18. The surface-mounted fuse of claim 16 or 17 wherein said longitudinal end portions of said fuse body are outwardly tapered to provide guide wall surfaces to guide said end caps into place over the fuse body ends during assembly.

19. The surface-mounted fuse of claim 16 or 17 combined with a printed circuit board having spaced parallel conductive areas on which corresponding outer surfaces of said end caps rest, and the space between said spaced conductive areas on said printed circuit board having a layer of adhesive extending between the outer surface of said central portion of said fuse body and said printed circuit board, to aid in securing said fuse to said printed circuit board.

* * * * *

UNITED STATES PATENT AND TRADEMARK OFFICE

CERTIFICATE OF CORRECTION

PATENT NO. : 5,214,406

DATED : May 25, 1993

INVENTOR(S) : Lloyd W. Reese et al.

It is certified that error appears in the above-identified patent and that said Letters Patent is hereby corrected as shown below:

Column 4, line 65, delete "15-1" and insert -- 15-15 --.

Column 5, line 68, after "7¼" delete "." and insert -- ° --.

Column 6, line 6, "0.01"" should be -- 0.001 --; line 9, "0.00039" should be -- 0.00039" --; line 14, "8"" should be -- 8' --.

Column 8, line 12, after "fuse of," delete "claim" and insert -- claims --.

Column 10, line 11, after "fuse of," delete "claim" and insert -- claims --; line 16, after "fuse of," delete "claim" and insert -- claims --.

Signed and Sealed this

Nineteenth Day of April, 1994

Bruce Lehman

*Attest:*

BRUCE LEHMAN

*Attesting Officer*

*Commissioner of Patents and Trademarks*